United States Patent [19]

Obst, deceased

[11] 4,415,214

[45] Nov. 15, 1983

[54] ELECTRICAL PLUG AND SOCKET CONNECTORS

[75] Inventor: Rudiger Obst, deceased, late of Detmold, Fed. Rep. of Germany, by Martha L. Obst, administrator

[73] Assignee: C. A. Weidmuller GmbH & Co. Postfach, Detmold, Fed. Rep. of Germany

[21] Appl. No.: 255,089

[22] Filed: Apr. 17, 1981

[30] Foreign Application Priority Data

Apr. 17, 1980 [DE] Fed. Rep. of Germany ..... 3014804

[51] Int. Cl.[3] ..... H01R 23/62

[52] U.S. Cl. ..... 339/91 R; 339/176 M; 339/186 M; 339/198 H

[58] Field of Search ..... 339/198 G, 198 H, 198 P, 339/91 R, 186 R, 186 M, 258 R, 176 M, 17 LC

[56] References Cited

U.S. PATENT DOCUMENTS

| | | | |
|---|---|---|---|
| 2,113,792 | 4/1938 | Ladd | 339/258 R |
| 2,928,066 | 3/1960 | Gordon | 339/198 G |
| 3,278,714 | 10/1966 | Bernutz | 339/91 R |
| 3,394,337 | 7/1968 | Miller | 339/91 R |

FOREIGN PATENT DOCUMENTS

| | | | |
|---|---|---|---|
| 1923128 | 11/1970 | Fed. Rep. of Germany . | |
| 2210844 | 9/1973 | Fed. Rep. of Germany . | |
| 7509792 | 7/1975 | Fed. Rep. of Germany . | |
| 2420047 | 11/1975 | Fed. Rep. of Germany | 339/198 P |
| 2315782 | 1/1977 | France | 339/186 M |
| 1294828 | 11/1972 | United Kingdom | 339/198 P |

*Primary Examiner*—John McQuade

*Attorney, Agent, or Firm*—Pollock, Vande Sande & Priddy

[57] ABSTRACT

An electrical plug and socket connector comprises a multi-pole plug assembly and a multi-pole socket assembly each composed of a plurality of plug and socket units, respectively. Each individual unit has two receptacles to receive pins which, depending on their arrangement in the receptacles of the individual units, serve as latching pins to hold the plug and socket assemblies together, or as coding pins to prevent incorrect connections. Any desired pattern of latching pins and coding pins in any desired number of plug and socket units can easily be provided by assembly of individual plug and socket units and pins.

9 Claims, 4 Drawing Figures

Figure 3:
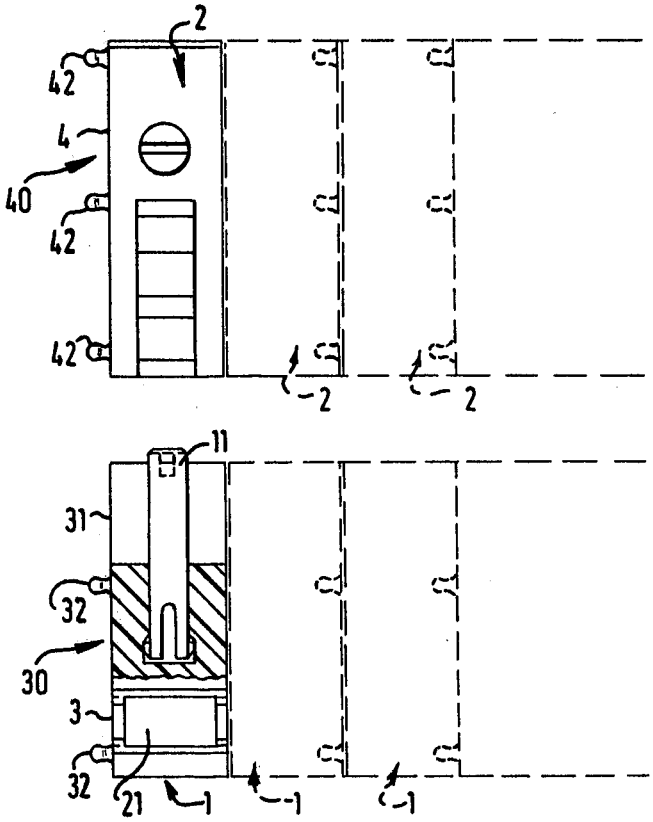

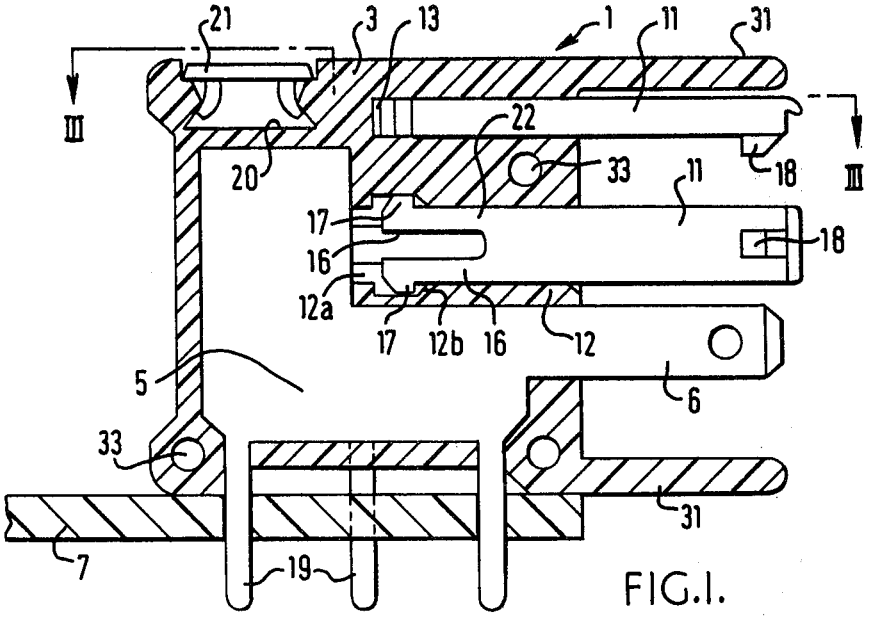
FIG.1.
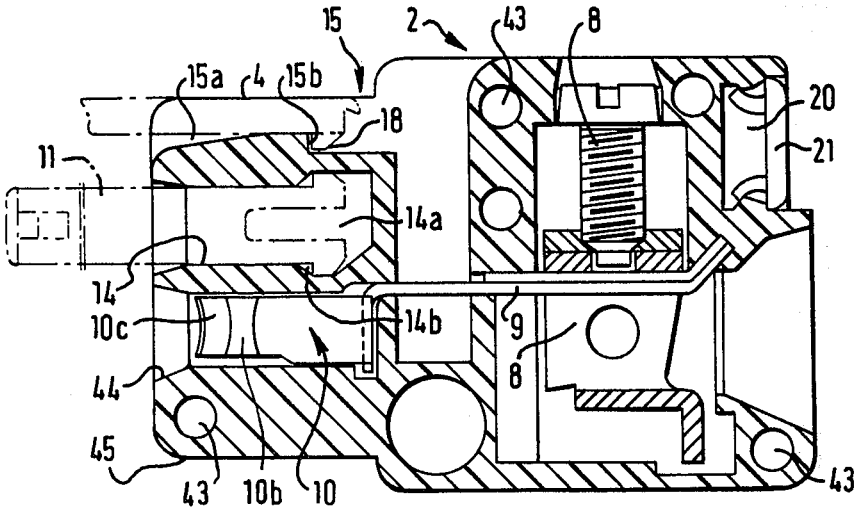

ELECTRICAL PLUG AND SOCKET CONNECTORS

This invention relates to electrical plug and socket connectors, in particular for use with electrical circuit boards.

Multi-pole electrical plug and socket connectors for printed circuit boards are well known. An example is described in German Published Patent Application No. 22 10 844. The plug part and socket part are prefabricated with a fixed number of poles in an integral insulating casing. The plug strip is secured by solder tags to a circuit board. The socket strip, when fitted to the plug strip, is mechanically retained by retaining means formed on or detachably mounted on one of the strips and engaging a corresponding receptacle or receptacles on the other strip. Because the number of poles is fixed by the manufacturer, as is the arrangement of the retaining means and receptacles, known plug and socket connector strips lack flexibilty in use.

There is a great need for plug and socket connector strips which allow the user to select a correct number of poles and a desired arrangement of latching means. It is an object of the present invention to provide an electrical plug and socket connector meeting this need. A further object is to provide such a connector in which the user can provide coding means to prevent incorrect coupling of the sockets with the plugs.

According to one aspect of the present invention, there is provided an electrical connector comprising a multi-pole plug assembly and a multi-pole socket assembly, inter-engageable plug contacts and socket contacts in said plug end socket assemblies, respectively, and latching means for releasably securing together said plug and socket assemblies, and in which:

(a) the plug assembly comprises a plurality of mechanically interconnected individual plug units, disposed side by side and containing respective plug contacts;

(b) the socket assembly comprises a corresponding plurality of mechanically interconnected individual socket units disposed side by side and containing respective socket contacts, to mate with respective corresponding plug units of the plug assembly; each said unit includes a housing containing the respective said contact and provided with two receptacles, the said receptacles in each plug unit being disposed to be aligned with the respective receptacles in the respective corresponding mating socket unit when the units are mated; and (c) at least one latching and coding pin is provided which is adapted to be mounted selectively in said receptacles and which is adapted to make latching engagement with a corresponding aligned receptacle or to constitute a coding means controlling the mating of said assemblies, according to the disposition of the pin or pins in said receptacles.

According to another aspect of the invention, there is provided a plug and socket connector, more particularly for circuit boards, having a plug part and a socket part which can be latched to each other via a detent element detachably mounted on one of the two parts, and via a detent receptor disposed on the other part, each plug part and each socket part being assembled from a plurality of individual plug units and individual socket units which can be connected to each other, two detent receptors being provided in each of the individual plug units and socket units, the two receptors of an individual plug unit being arranged in alignment respectively with the two receptors of the corresponding individual socket unit, and a separate detent and coding pin being provided for optional engagement with one of the receptors of one of the individual units.

A connector according to the invention essentially comprises only three kinds of part, namely, plug units, socket units, and pins which are inserted selectively in particular plug units and/or socket units. Depending on the arrangement of the pins, these serve for latching together the plug and socket assemblies, or as coding pins to prevent incorrect coupling of the plug assembly with the socket assembly.

The user can build up from the individual plug and socket units plug and socket assemblies having any desired number of poles, and by selective insertion of the pins in selected receptacles can provide any suitable arrangement of latching means and of coding means for controlling the mating of the plug and socket assemblies. The construction of a plug and socket connector corresponding exactly to the user's requirements is very quick and simple.

The pins are preferably asymmetrical, having one end designed to be retained in a receptacle and the other end forming a latch for latching together the plug and socket assemblies. The latch ends also perform the coding function, preventing incorrect coupling or mating of the plug and socket assemblies depending on how the pins are arranged.

Coding is achieved as follows. If a pin is mounted in one unit, and the corresponding receptacle in the mating unit is empty, then the two units can be mated or coupled. If however, the aligned receptacle in the second unit also contains a pin, then the two units cannot be mated, because the pins will abut end to end. By suitable arrangement of the coding pins, the user can assure that a socket assembly cannot be mated with a plug assembly for which it is not intended (and vice versa), and also that a socket assembly cannot be incorrectly mated with the plug assembly for which it is intended. The coding is entirely under the control of the user and can therefore be adapted to the requirements of any particular installation, for example being extended throughout the connectors of a control cabinet, using only a small number of different parts all of which can be relatively easily manufactured and assembled.

Because there are two receptacles in each unit, any unit can be provided with two pins of which one serves for coding and the other for latching.

In a preferred arrangement, in each pair of units compirsing a plug unit and corresponding socket unit, three of the receptacles are designed to retain pins inserted therein, and one receptacle is designed to function solely as a latching means for a pin mounted in the corresponding receptacle of the other unit of the pair.

The use of individual connector units to assemble multi-pole connectors is known, for example, from German Published Application No. 19 23 128, but these assemblies do not permit selective coding and latching. Coding means are known, for example, from German Utility Model Specification No. G 75 09 792, but known coding devices are predetermined by the manufacturer.

Figure 4:
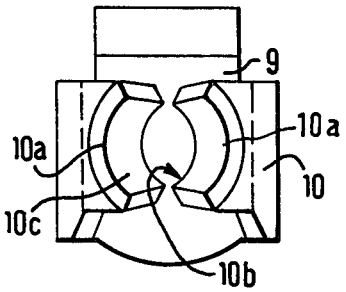

The invention will be further described, by way of example only, with reference to the accompany drawings in which:

FIG. 1 is a side view in section through an individual plug unit mounted on a printed circuit board, FIG. 2 is a corresponding section through a socket unit, FIG. 3 is a plan view, partly in section on the line III—III of FIG. 1, showing plug and socket units according to FIGS. 1 and 2 forming part of plug and socket assemblies, and FIG. 4 is an end view of a socket contact.

The plug unit 1 shown in FIG. 1 has a housing 3 of insulating plastic material with plane parallel sides, as can be seen in FIG. 3. In the housing is a plug contact element 5 with a projecting plug pin 6 of rectangular cross-section and with three integral solder tags 19 by which the plug unit is mechanically attached and electrically connected to a printed circuit board 7. At the same side as the plug pin 6, the insulating housing has projecting protective shrouds 31. Any desired number of such plug units are fastened together side by side by means of their insulating housings 3 to form a plug assembly 30 as shown in FIG. 3. The mechanical interconnection of the housings can be effected in any convenient way. The drawings show detent pins 32 on one side of the housing, which latch into holes or recesses 33 in the side of the housing of an adjacent unit.

Each socket unit 2 has an insulating housing 4 with plane parallel sides, as can be seen in FIG. 3. The housing contains a spring socket contact 10 which is accessible through an entry aperture 44 corresponding in position to the plug pin 6 of a plug unit. The contact 10 is connected by a metal bar 9 to a screw-clamping terminal 8 to which an electrical conductor can be connected. Alternatively, the terminal can be a solder tag, a wire-wrap or crimping pin, or any other convenient form of terminal. The housing 4 has a projecting forward portion 45 which accommodates the socket contact 10 and is adapted to fit within the shrouds 31 of a plug unit. Any desired number of socket units can be assembled together to form a socket assembly 40 analogous to the plug assembly 30, as shown in FIG. 3. The individual socket unit housings are mechanically interconnected by detent pins 42 on one side of each housing, fitting in recesses 43 in the side of an adjacent housing.

The plug and socket assemblies thus formed can be coupled together so that each plug pin 6 enters the corresponding spring socket 10 in order to connect the terminals 8 to respective solder tags 19. Each individual housing has a channel 20 for receiving an identification plate 21.

To hold the plug and socket assemblies together, one or more latching pins 11 are provided. In the illustrated embodiment, the pins serving for latching the plug and socket assemblies together are mounted in selected plug units and latch on to the corresponding socket units. Identical pins can also be used as coding means to prevent incorrect mating of plug and socket assemblies.

Each plug unit housing contains two pin receptacles 12, 13, one above the other. The pins are of elongate rectangular cross-section and the receptacles have corresponding cross-sections. The major transverse dimension of the upper receptacle 13 is parallel to the base of the plug unit housing 3, whereas the corresponding dimension of the lower pin receptacle 12 is at 90° thereto. Each of these receptacles has at its rear end an enlarged chamber 12*a* defining shoulders 12*b*. The receptacle 13 is identical in form to the receptacle 12.

The pins 11 are asymmetrical. The pin has a rear end 22 which is bifurcated, forming limbs 16 which are resilient by virtue of the resilience of the material of the pin, for example plastic. At the free end of each limb is a retaining hook 17 projecting from the narrow side of the pin. These hooks engage the shoulders 12*b* of the pin receptacle to retain the pin in the housing. The pin can be inserted into the housing by virtue of the resilient flexing of the limbs 16.

Each pin has at its other end a latching hook 18 projecting from a broad side of the pin.

Each socket unit housing has a pin receptacle 14 which corresponds in position, cross-section and orientation to the receptacle 12 of a plug unit.

Each receptacle 14 has at its rear end a wider chamber 14*a* defining shoulders 14*b* for retaining the hooks 17 of an inserted pin 11, as shown in broken lines in FIG. 2.

Each socket unit housing also has in the upper part of its forward region a receptacle 15 corresponding in position to the receptacle 13 of a plug unit. The receptacle 15 is an upwardly open channel 15*a* with a slightly oblique lean-in surface in its front region and a downward step 15*b* forming a rearwardly facing abutment surface or shoulder.

In practice, one or more of the plug units is provided with a latching pin 11 in the upper receptacle 13. The user need only fit enough latching pins to provide reliable connection of the plug and socket assemblies, regardless of the number of individual pole units in these assemblies. When the plug and socket units are mated, the latching hook 18 of the latching pin 11 slides into the channel 15*a* of the receptacle 15 and then snaps down behind the shoulder 15*b*, as shown in broken lines in FIG. 2. The described construction provides reliable latching with a minimum number of parts which can be adapted to individual circumstances.

For use as coding pins, the pins 11 are inserted into the receptacles 12 and/or 14 of selected units. Mating of the plug and socket assemblies is possible, provided that the unit which faces a unit fitted with a coding pin 11 is not itself fitted with a coding pin. I.e., if a plug unit has a pin in its receptacle 12, the receptacle 14 of the corresponding socket unit must be empty to receive the projecting end of the coding pin. The receptacles 12 and 14 are so designed as to receive the hooks 18 of latching pins without making latching engagement with these.

However, if an attempt is made to couple plug and socket assemblies in which corresponding plug and socket units both contain coding pins 11 in the respective receptacles 12, 14 clearly the coding pins will prevent such coupling. In general, the opposed coding pins will abut end to end and thereby prevent the plug pins 6 from coming anywhere near the socket contacts 10. FIG. 1 shows a coding pin in the receptacle 12, and FIG. 2 shows in broken lines a coding pin in the receptacle 14.

By way of example, the socket units adjacent to the socket unit corresponding to the plug unit fitted with a coding pin, may all be fitted with coding pins, so that the plug and socket assemblies containing these units can only be fitted together in one position.

The coding pins can also be used to prevent coupling of plug and socket assemblies which do not belong with one another.

The coding pin positions can be identified by markings applied to the individual units, for example by means of the marking plates 21.

Because the user can select his own coding pin arrangements, such coding can easily be extended throughout a large installation, for example throughout an entire control cubicle.

In the described embodiment, the coding pin receptacles are set at 90° to the latching pin receptacles. This makes it easy for the user to distinguish between the two different functions of the pins which are identical in form, so that a pin will not be inserted in a position inappropriate to its desired function, namely, latching or coding.

Since each unit has two receptacles for pins, a single unit can perform both a latching and a coding function. However, an individual unit may contain only a single pin, for latching or coding, or no such pins.

Individual unit housings may contain different kinds of terminal. Thus, a socket assembly, or a plug assembly, can be constructed from individual units, so as to contain a variety of terminals, according to the requirements of a particular installation. For example, individual plug units may have rectangular pins, round pins, square pins or flat blades. FIG. 4 illustrates a form of socket contact capable of accommodating all these kinds of plug pin, so that only a single kind of socket unit is required. The socket 10 is made of sheet metal, integral with the connecting bar 9. It has two opposite contact arms 10*a* each of which, in cross section, is semi-oval, so that the arms define between them an oval space to receive a plug pin. The free ends of these arms define a conically tapering entry region 10*c* which leads to a constricted contact region 10*b* extending substantially rectilinearly over a specific distance, thereafter widening towards the rear of the socket contact. This construction permits good contact with a square pin, a round pin, or a flat blade contact.

I claim:

1. An electrical connector comprising a multi-pole plug assembly and a multi-pole socket assembly, interengageable plug contacts and socket contacts in said plug and socket assemblies, respectively, and latching means for releasably securing together said plug and socket assemblies, wherein:

(a) said plug assembly comprises a plurality of mechanically interconnected individual plug units, disposed side by side and containing respective plug contacts;

(b) said socket assembly comprises a corresponding plurality of mechanically interconnected individual socket units disposed side by side and containing respective socket contacts, to mate with respective corresponding plug units of said plug assembly;

(c) each said unit includes a housing containing the respective said contact and provided with two receptacles, said receptacles in each plug unit being disposed to be aligned with the respective receptacles in the respective corresponding mating socket unit when the units are mated;

(d) at least one latching and coding pin is provided which is adapted to be mounted selectively in said receptacles and which is adapted to make latching engagement with a corresponding aligned receptacle or to constitute a coding means controlling the mating of said assemblies, according to the disposition of the pin or pins in said receptacles; and (e) each pair of units comprising a plug unit and the mating socket unit has a first pair of aligned receptacles comprising a first receptacle in a first of said units adapted to retain a said pin mounted therein and a second receptacle in the second of said units adapted for latching engagement by a said pin mounted in said first receptacle; and a second pair of aligned receptacles comprising a third receptacle in said first unit and a fourth receptacle in said second unit, each of said third and fourth receptacles being adapted to retain a pin mounted therein but not to make latching engagement with a pin mounted in the respective aligned receptacle, whereby pins selectively mounted in said third and fourth receptacles can be used for coding said plug and socket assemblies.

2. A connector as claimed in claim 1, wherein at least one said pin is mounted in each of said assemblies, said pins being disposed in a coded arrangement adapted to prevent by mutual abutment of said pins incorrect mating of said plug and socket assemblies.

3. A connector as claimed in claim 1, wherein said pin has at one end retaining means adapted to retain said one end in a selected one of said first, third and fourth receptacles, and has at its opposite end latching means adapted to latch into a said second receptacle.

4. A connector according to calim 3, wherein said one end of said pin is bifurcated and the sides of the free limb ends of the bifurcate end have outwardly projecting hooks, and one side of said opposite end is provided with a hook which is disposed at 90° in relation to the first mentioned hooks.

5. A connector according to claim 1, wherein said first unit is a plug unit and each of said first and third receptacles comprises a chamber which has a widened rear region and an elongate cross section, the cross section of said first and third receptacles being offset through 90° with respect to one another.

6. A connector according to claim 5, wherein said fourth receptacle corresponds in shape and position to the associated second receptacle.

7. A connector according to to claim 1, wherein said second receptacle has an open top and has a lower rear region with a rearwardly facing abutment surface for latching engagement with a said pin.

8. A connector according to claim 1, wherein each socket contact is a contact constructed for the reception of a plug contact pin selected from the group comprising a round pin, a rectangular pin and a flat blade.

9. A connector according to claim 8, wherein said spring socket contact has two spring arms of semi-oval shape which jointly define an oval, and the region between said arms comprises a tapering entry region, and a substantially rectilinear contact region adjoining said entry region which is expanded towards the rear of said socket contact.

* * * * *